US005149927A

United States Patent [19]

Stahly

[11] Patent Number: 5,149,927

[45] Date of Patent: Sep. 22, 1992

[54] BINARY ACTION PRESSURE SWITCH

[75] Inventor: Daniel Stahly, Elmhurst, Ill.

[73] Assignee: Eaton Corporation, Cleveland, Ohio

[21] Appl. No.: 680,870

[22] Filed: Apr. 5, 1991

[51] Int. Cl.[5] ..... H01H 35/26

[52] U.S. Cl. ..... 200/83 P; 200/83 J

[58] Field of Search ..... 200/81.4, 83 R, 83 A, 200/83 B, 83 WM, 83 J, 83 P, 83 T

[56] References Cited

U.S. PATENT DOCUMENTS

| | | | |
|---|---|---|---|
| 4,200,776 | 4/1980 | Poling | 200/83 P |
| 4,287,780 | 9/1981 | Poling | 200/83 P X |
| 4,330,695 | 5/1982 | Poling | 200/83 P |
| 4,410,776 | 10/1983 | Stoll | 200/83 P |
| 4,757,165 | 7/1988 | Marcoux et al. | 200/83 P |
| 4,794,214 | 12/1988 | Sanford | 200/83 P |
| 4,820,890 | 4/1989 | Tamura et al. | 200/81.4 |
| 4,939,321 | 7/1990 | Tanaka et al. | 200/83 P |

OTHER PUBLICATIONS

SAE Paper 860472, C. E. Stanford, "Snap Action Pressure Switches for Automotive Auxiliary Systems Control", 1986.

*Primary Examiner*—J. R. Scott

*Attorney, Agent, or Firm*—R. A. Johnston

[57] ABSTRACT

A make-before-break pressure switch has a pair of snap-acting discs separated by a travelling spacer. At a low level switching pressure, the travelling spacer is moved by the pressure sensing diaphragm to snap one disc for moving a contact blade to close a pair of contacts. On increasing pressure, the second disc is snapped at a high level switching pressure to cause a blade spring to go over-center and effect snap actuation of the contact blade to re-open the contacts. Upon decreasing pressure reverse operation occurs; and, the over-center blade snaps the blade to close the contacts which remain closed until a low level opening pressure is reached.

9 Claims, 2 Drawing Sheets

BINARY ACTION PRESSURE SWITCH

BACKGROUND OF THE INVENTION

The present invention relates to pressure responsive electrical switch assemblies, in particular to pressure switch assemblies of the type wherein it is desired to have a pair of electrical contacts that, upon increasing fluid pressure to a sensing cavity, close at a specified pressure, remain closed upon increasing pressure, and reopen at a predetermined upper limit pressure. Upon decreasing pressure from the upper limit, the contacts reclose at a specified differential below the upper limit pressure, remain closed for a predetermined pressure differential, and then again reopen at a point below the initial closing pressure on increasing pressure. Such pressure switch action is sometimes referred to as "make-before-break" action. This type of pressure switch operating characteristic has found particular application in automotive air conditioning systems for controlling the cycling of the compressor clutch in response to sensed variations in the pressure of the refrigerant entering the expansion valve.

In providing pressure switches capable of responding as described above to increasing and decreasing pressure over a broad range of pressures, it has been desirable to provide a snap-action to the switch to prevent arcing and prolong the life of the electrical contacts. However, in order to provide snap-action to the making and the breaking of the switch, it has proved difficult to provide a make-before-break operation on increasing pressure because continued travel of the pressure responsive means in one direction upon increasing pressure after the making of the contacts has been found to be mechanically complicated. Known devices for achieving this type of operation have employed beam type springs, wherein the pivot point of the spring is changed by contacting a stationary support after a predetermined amount of movement. Upon continued movement flexure of the spring is reversed about the stationary pivot, thereafter increasing the stiffness of the spring and decreasing the sensitivity of the switch.

It has thus been desired to provide a pressure switch capable of make-before-break operation on increasing pressure and similar make-before-break on decreasing pressure, which has a construction that is simple and relatively low in cost to fabricate and assemble in mass production, and which provides reliable operation.

SUMMARY OF THE INVENTION

The present invention provides a pressure switch employing a snap-acting blade and spring arrangement for the movable one of a pair of electrical contacts. The pressure switch of the present invention employs a pressure responsive diaphragm forming one wall of a cavity exposed to the pressure to be sensed; and, the diaphragm acts against a pair of snap-acting discs separated by a travelling spacer. A plunger has a portion passing through one of the discs and the spacer to contact the stiffer of the pair of discs. Upon increasing pressure the movable spacer causes snap-action of the one disc to move the plunger to cause the movable contact blade spring to close. Upon further increases in pressure, the stiffer diaphragm snaps to effect further movement of the plunger, in lost motion with respect to the first disc, to cause the blade spring to go to an over-center condition to effect snap-action opening of the closed contacts.

Upon decreasing pressure, the plunger moves the snap-action spring to effect reverse snap-action to close the contacts after a predetermined dead-band. Further decreases in the sensed pressure allow the plunger to move further and cause the first disc to reverse its snap-action and move the contact blade again to the open position.

The present invention thus employs a unique arrangement of snap-acting discs separated by a travelling spacer to provide staged snap-action of the discs against a plunger for effecting movement of a blade member at a desired low measure without effecting snap-acting thereof; and, upon further movement to effect snap-acting of a blade member.

DETAILED DESCRIPTION

Figure 1:
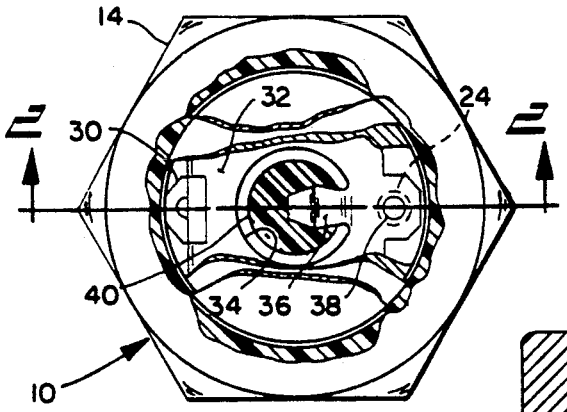
FIG. 1 is a top view of a pressure switch of the present invention having portions of the cover broken away to expose the switchblade mechanism.
Figure 2:
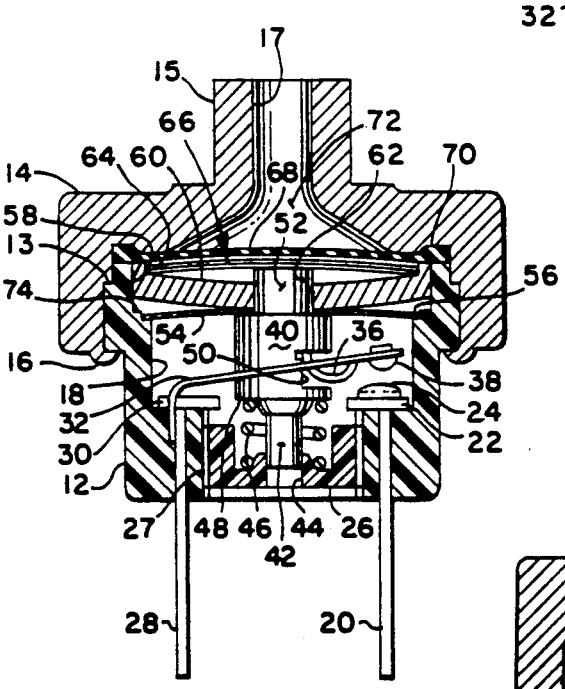
FIG. 2 is a section view taken along section indicating lines 2—2 of FIG. 2, showing the switch in the unpressurized state.

Referring to FIGS. 1 and 2, the pressure switch assembly of the present invention is indicated generally at 10, and has a housing or body 12 formed preferably of a suitable relatively high temperature thermoplastic material capable of withstanding temperatures of 225° F. Body 12 has an inlet fitting or cover member 14 formed of metallic material received thereover and retained thereon by any suitable expedient as, for example, orbital staking for deformation of material as illustrated by the rolled-over portion 16. Cover 14 is registered on ledge or shoulder 13 formed on body 12. Cover 14 has an inlet portion of reduced diameter and having inlet passage 17 therein.

The housing 12 has a recess or chamber 18 formed therein, which has an electrical terminal 20 received through the wall thereof and extending exteriorly of the housing, and which has a stationary electrical contact 24 attached to the portion 22 of the electrical terminal which extends interiorly of the cavity 18. The lower portion of the housing 12 has an adjustable plug 26 threadedly engaging the body by threads 27 received therein for adjustment as will hereinafter be described.

A second electrical terminal 28 extends through the lower wall of the housing 12 and has a right-angled portion 30 thereof disposed interiorly of the cavity 18 and terminal 28 has attached rigidly thereto an electrically conducting blade member 32. Blade member 32 extends in cantilever from the terminal 28, and has an aperture 34 formed therein with an inwardly extending, spring portion tab 36 generally U-shaped in side view formed integrally therewith, which provides an over-center snap-action to the blade member. Blade 32 has a movable electrical contact 38 attached to the free end thereof, and disposed directly above the stationary contact 24. The contact 38 being preferably attached to the blade member 32 by any suitable expedient as, for example, riveting.

A plunger member 40 has a reduced diameter portion 42 thereof slidably received in a bore 44 formed in plug 26. The plunger is biased in an upward direction by coil spring 46, which has the lower end thereof registered against plug 26, and the upper end registered against shoulder 48 provided on the plunger 40. Plunger 40 has a notch 50 formed in the side thereof, which notch has registered thereagainst the end of blade spring tab 36 to thereby form the U-shaped configuration of the spring tab 36.

The upper end of plunger 40 also has a reduced diameter portion 52 which is received through a central aperture formed in a metallic washer 54 which is dished to provide a snap-action in the vertical direction, and which has its outer periphery registered in a ledge 56 formed in the wall of the cavity 18. A counterbore 58 is provided in the wall of cavity 18 above the ledge 56. A rigid metal washer 60 has its outer periphery registered against the counterbore 58 in slidably guided arrangement and has a central aperture 62 which has received therein in guided free-sliding arrangement the reduced diameter portion 52 of plunger 40.

The spacer 60 has a recess or a counterbore 64 formed in the upper face thereof which recess has received therein and registered thereagainst the outer periphery of a plurality of metal discs indicated generally at 66, and which have a dished configuration to provide a snap-acting movement thereto. The discs 66 are curved so as to have the upper surface thereof convex in the free state. The undersurface of the lower disc contacts the upper end of the portion 52 of plunger 40. In the presently preferred practice, the upper snap discs 66 comprise at least one, and preferably three (3), thin metal discs. A flexible diaphragm 68 is disposed over, and covers the cavity 18, and has a bead rim 70 formed about the outer periphery thereof or a separate seal, which is pressed and sealed between cover 14 and the upper edge of the wall of cavity 18 to thereby seal the inlet 17 and form the lower wall of a pressure sensing cavity 72.

Figure 3:
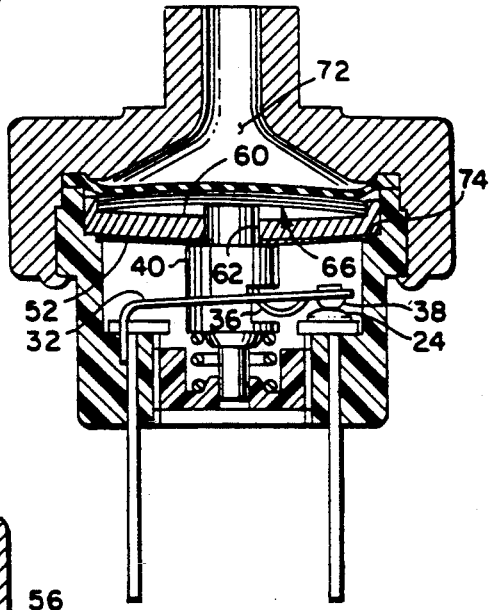
FIG. 3 is a view similar to FIG. 2 showing the switch with the contacts closed upon experiencing a predetermined low threshold pressure.

The discs 66 are designed such that upon increasing pressure, when the pressure in chamber 72 reaches 30 psi, the force acting on the diaphragm 68 is sufficient to cause movement of the lower spacer 60 downwardly to cause lower snap disc 54 to snap downwardly to a concave configuration on the upper surface thereof, as illustrated in FIG. 3. The downward movement of the spacer 60 is sufficient to cause the plunger 40 to move the end of spring tab 36 downwardly to permit the blade 32 to drop to a position closing contact 38 against contact 24.

However, it will be understood that at the 30 psi pressure level in chamber 72, the end of spring tab 36 is above the blade member 32 and therefore the over-center action of the blade spring does not take place in the state shown in FIG. 3. In the condition shown in FIG. 3, the blade member 32 is maintained downwardly, closing the contact pair 38, 24 under the urging of the U-shaped spring portion 36. It will be noted that in the condition shown in FIG. 3, the spacer 60 has bottomed out against ledge 74 provided in the body 12, and further movement of the lower snap disc 54 is thus prevented.

Figure 4:
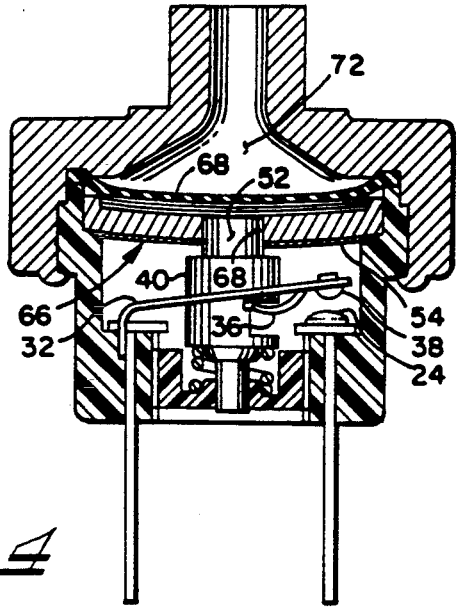
FIG. 4 is a view similar to FIG. 2 showing the switch in the high threshold pressure state with the snap-action blade mechanism in the actuated state.

Referring to FIG. 4, upon chamber 72 experiencing further increases in pressure above that of the condition of FIG. 3, diagram 68 exerts a force on the upper discs 66, causing downward snap-action thereof, which pushes the end 52 of plunger 40 downward in aperture 68. The end of U-shaped spring tab 36 is thus moved through the aperture 34 in the blade and downwardly to the position shown in FIG. 4 which effects a snap-action of the blade member 32 to the upward position shown in FIG. 4, thereby breaking contact between the contacts 38, 24.

Figure 5A:
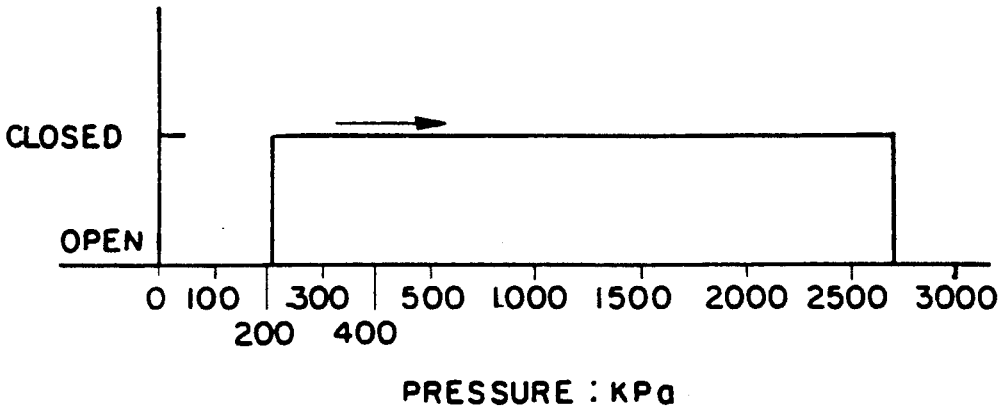
FIG. 5*a* is a graph of switch contact movement upon increasing pressure at the inlet, and, FIG. 5*b* is a graph similar to FIG. 5*a* of contact movement on decreasing pressure.
Figure 5B:
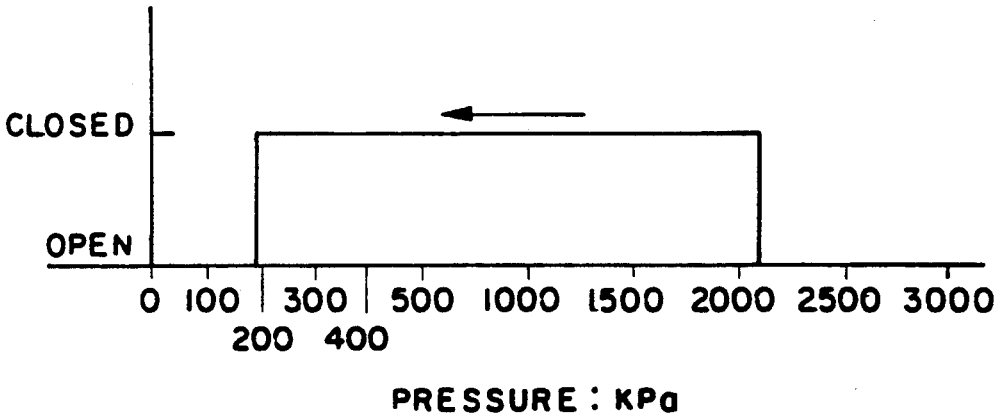

The position of the contacts is shown in FIG. 5 plotted graphically as a function of pressure for both increasing and decreasing pressure. From the graph in FIG. 5, it will be seen that upon decreasing pressure the contacts close at a pressure below the upper level snap open pressure and reopen at a predetermined differential therebelow. In the present practice of the invention, for a typical automotive air conditioning application, on increasing pressure, the contacts close at 30 psi and snap open again at 390 psi; and, on decreasing pressure the contacts reclose by snap-action at 300 psi and reopen at 28 psi.

It will be understood that the threaded plug 26 is rotatable for effecting changes in the length of spring 46, thereby changing the preload on actuator 40, thus permitting calibration of the switch for actuation at the desired pressures.

The present invention thus provides a unique and novel pressure switch with a step-function operation for make-before-break mode of actuation upon increasing or decreasing pressure. The present invention is economical to manufacture as well as simple to assemble and calibrate, and is reliable in operation and may be externally adjusted for calibration.

Although the invention has hereinabove been described to the illustrated embodiments, it will be understood that the invention is capable of modification and variation, and its scope is specifically set forth by the following claims:

I claim:

1. A make-before break binary action pressure switch comprising:

(a) housing means defining a pressure sensing cavity and having a fluid pressure inlet port formed therein, and including a pressure responsive member forming a portion of the boundary of said cavity and movable in response to pressure changes in said cavity;

(b) switch means disposed in said housing means, said switch means including a contact carrying a blade member movable between a first position closing said contact on a stationary contact and a second position opening said contact;

(c) a switch actuator member movably disposed in said housing means;

(d) first spring means operative to bias said actuator member and said pressure responsive member in one direction;

(e) second spring means having one reaction end operatively contacting said actuator member and the opposite reaction and operatively contacting said blade member; and, (f) with no pressure signal applied to said inlet port, said first spring means is operative to bias said pressure responsive member and actuator member to a position such that said second spring is operative to effect movement of said blade member to said second position, and upon said inlet port experiencing a first predetermined first level of pressurization, said pressure responsive member is operative to overcome said bias of said first spring means and effect movement of said actuator member in a direction opposite said one direction to a first position, whereupon said second spring means effects movement of said blade member to said first position, and upon said inlet port experiencing increasing pressurization to a second level a predetermined amount above said first level, said pressure movement of said actuator member to effect further movement of said actuator member in said direction opposite said one direction to second position whereupon said second spring means effects movement of said blade member against said first position, and upon decreasing pressurization of said inlet to a third level intermediate said second and first level said pressure responsive member is operative to effect movement of said actuator member in said one direction to a third position whereupon said second spring means is again operative to effect movement of said blade member to said first position, and upon further decreasing pressurization of said inlet port to a fourth level less than said first level said pressure responsive member causes said actuator member to move in said one direction to a fourth position whereupon said second spring means is operative to again effect movement of said blade member to said second position.

2. The pressure switch defined in claim 1, wherein said spring means includes an over-center mechanism for effecting a snap-action of said blade member.

3. The pressure switch defined in claim 1, wherein said spring means includes a snap-acting metal diaphragm.

4. The pressure switch defined in claim 1, wherein said spring means includes at least one Belleville spring washer.

5. The pressure switch defined in claim 1, wherein said spring means undergoes a snap-action upon reaching said first level of pressurization; and, said spring means undergoes an over-center toggle action upon said cavity reaching said second level of pressurization.

6. The pressure switch defined in claim 1, wherein said wall structure includes first and second snap-acting disc means.

7. The pressure switch defined in claim 1, wherein said wall structure includes a first snap-acting disc means having a plurality of layers and a second snap-acting disc means spaced from said first diaphragm means by spacer means movable therewith.

8. The pressure switch defined in claim 1, wherein said movable wall structure includes a flexible diaphragm, a snap-acting metal disc, and a rigid actuator member disposed intermediate said metal disc and said spring means.

9. The pressure switch defined in claim 1, wherein said actuator means includes:

(a) a rigid washer received in said housing means and guided for a sliding movement therein;

(b) at least one snap-acting metal disc received on said rigid washer for movement therewith;

(c) a rigid plunger member slidably received through said rigid washer and having an end thereof contacting said snap-acting disc; and, (d) a second snap-acting disc having the periphery thereof mounted on said housing means, an aperture therein with said received therethrough, said second snap-acting disc registered against said rigid washer.

* * * * *